US005914604A

United States Patent [19]

Bahr et al.

[11] Patent Number: 5,914,604

[45] Date of Patent: Jun. 22, 1999

[54] CIRCUIT ARRANGEMENT FOR MEASURING AN ION CURRENT IN A COMBUSTION CHAMBER OF AN INTERNAL COMBUSTION ENGINE

[75] Inventors: Ulrich Bahr, Brunswick; Michael Daetz, Tiddische, both of Germany

[73] Assignees: Daimler-Benz Aktiengesellschaft, Stuttgart; Volkswagen AG, Wolfsburg, both of Germany

[21] Appl. No.: 08/802,898

[22] Filed: Feb. 18, 1997

[30] Foreign Application Priority Data

Feb. 16, 1996 [DE] Germany ..... 196 05 803

[51] Int. Cl.[6] ..... F02P 17/12

[52] U.S. Cl. ..... 324/399; 324/393; 324/402; 73/35.08

[58] Field of Search ..... 324/378, 384, 324/388, 390, 392, 393, 399, 402; 73/35.08; 123/169 EL, 169 G, 169 R, 425, 618, 620

[56] References Cited

U.S. PATENT DOCUMENTS

| | | | |
|---|---|---|---|
| 5,293,129 | 3/1994 | Ikeuchi et al. | 324/399 |
| 5,444,375 | 8/1995 | Ohsawa et al. | 324/399 |
| 5,483,818 | 1/1996 | Brandt et al. | 324/393 |
| 5,493,227 | 2/1996 | Shimasaki et al. | 324/388 |
| 5,548,220 | 8/1996 | Kawamoto et al. | 324/399 |
| 5,561,239 | 10/1996 | Yasuda | 324/399 |

FOREIGN PATENT DOCUMENTS

| | | |
|---|---|---|
| 0260177 | 3/1988 | European Pat. Off. . |
| 0305347 | 3/1989 | European Pat. Off. . |
| 3006665 | 9/1981 | Germany . |
| 3327766 | 2/1985 | Germany . |
| 4233224 | 4/1993 | Germany . |
| 4239803 | 5/1993 | Germany . |
| 4303267 | 8/1993 | Germany . |
| 19502402 | 8/1995 | Germany . |
| 06-299941 | 10/1994 | Japan . |

*Primary Examiner*—Diep N. Do
*Attorney, Agent, or Firm*—W. F. Fasse; W. G. Fasse

[57] ABSTRACT

An ion current in the combustion chamber of an internal combustion engine is measured by using the spark plug as an ion current sensor. The ignition circuit arrangement has an ignition coil or transformer with a primary winding forming a primary circuit and a secondary winding forming a secondary circuit in which the spark plug is connected. A measuring voltage is applied to the secondary circuit by circuit components forming a measuring circuit for measuring the ion current. The measuring circuit provides a measuring voltage at a value that is lower than the battery voltage of the ignition system or corresponds to the battery voltage at most. A rectifying element is connected to the secondary circuit which feeds the secondary or ignition current into the battery circuit of the ignition system while an ion current caused to flow by the measuring voltage applied to the secondary circuit is measured between sparking times when no ignition current is flowing.

7 Claims, 2 Drawing Sheets

CIRCUIT ARRANGEMENT FOR MEASURING AN ION CURRENT IN A COMBUSTION CHAMBER OF AN INTERNAL COMBUSTION ENGINE

CROSS-REFERENCE TO RELATED APPLICATIONS

The present application is related to our copending, commonly assigned application U.S. Ser. No. 08/802,896, filed Feb. 18, 1997, and U.S. Ser. No. 08/802,889, filed Feb. 18, 1997, now U.S. Pat. No. 5,758,629.

INCORPORATION BY REFERENCE

The disclosure of German parent case No. 196 05 803.1, filed on Feb. 16, 1996 is hereby incorporated by reference into the present disclosure.

FIELD OF THE INVENTION

The invention relates to a circuit arrangement for measuring an ion current in the combustion chamber of an internal combustion engine with the aid of the ignition circuit of such engine having an ignition coil with a primary winding and a secondary winding.

BACKGROUND INFORMATION

Ion current measuring devices of the type mentioned above are known from German Patent Publications DE-OS 30 06 665 and from DE 19 50 24 02 A1.

The circuit arrangement of German Patent Publication DE-OS 30 06 665 uses a Zener diode or a varistor connected between the high voltage ignition source and the spark plug. A constant voltage drop is provided by the Zener diode or varistor. A capacitor is so connected to the circuit that the voltage drop across the Zener diode or varistor charges the capacitor, whereby the capacitor becomes a measuring voltage source. The capacitor may be connected in parallel to the Zener diode or the varistor may be connected to the capacitor through further diodes that are connected to permit the flow of a loading current.

The circuit arrangement of German Patent Publication DE-OS 30 06 665 is relatively simple, however it requires a large storage capacitor. Moreover, the measuring voltage is not constant, especially when measuring phases of long duration are involved which can occur when the engine runs at a low r.p.m. The voltage is not constant because the storage capacitor is discharged by the flow of the measuring current. Further, an undesirable current is superimposed on the current to be measured. The undesirable current is generated by the discharge of stray capacities in the spark plug, in the ignition coil or transformer and in the wiring of the circuit. A leakage current is also superimposed on the ion current to be measured. This leakage current is caused by the Zener diode which is used for limiting the voltage. Still another disadvantage of the just mentioned circuit arrangement is seen in that the resistor for measuring the current is connected in series with the storage capacitor, whereby a non-linearity is imposed on the measuring circuit. As a result, the voltage drop across the ion measuring path is no longer linearly proportional to the current value to be measured, whereby the known circuit is not very accurate.

The circuit arrangement by German Patent Publication 195 02 402 A1 discloses applying a positive voltage to the spark plug in order to sense an ion current having a negative polarity generated by the combustion. The positive voltage is generated by a capacitor which is connected to the low potential side of the secondary winding of the ignition transformer. This capacitor is charged through a diode by the electric ignition current in order to obtain a voltage with a positive polarity. A Zener diode is connected to make sure that the voltage across the capacitor is limited. The current flowing through the capacitor is the ion current to be measured. This ion current is supplied to a current voltage converter in order to convert the ion current into a voltage representing the ion current. Here again the disadvantage is seen in that the capacitor imposes a nonlinearity into the relationship between the measured voltage representing the ion current to be measured and the current itself because the negative terminal of the capacitor is maintained at a virtual ground potential.

Furthermore, both circuit arrangements described above have another disadvantage in that for the measuring of the ion current a voltage in the range of 70 to 400 V is necessary. Such relatively high voltage is applied to the ion measuring gap of the spark plug of the combustion engine. Such higher voltage makes the respective circuit component more expensive.

It is also known that the use of a measuring voltage of about 400 V greatly increases the sooting speed during cold starting of the combustion engine, whereby the spark gap is quickly contaminated as is, for example, described in European Patent Publication EP 0,305,347 B1.

German Patent Publication DE-OS 3,327,766 describes a circuit arrangement for measuring the ion current in which the measuring voltage is produced by an alternating voltage applied to the primary winding of the ignition coil or transformer, whereby the alternating voltage is stepped up in the ignition transformer to a higher voltage level, and whereby frequencies in the range of 10 kHz to 100 kHz are used. The ion current signal causes an amplitude modulation of the alternating currents as generated in the secondary winding of the ignition coil. Such a system has the disadvantage that on the one hand it requires the use of filters to filter out the ion current signal having a useful frequency within the range of 100 Hz to 20 kHz in order to separate this ion current frequency from the carrier signal. On the other hand, the ion current characteristic curve is non-symmetric or non-linear, whereby the alternating generation of the ion current is subject to non-linear distortions. This non-symmetry or the respective non-linear distortion is the result of the higher movability of the negative load carriers relative to the positive ions. As a result, where non-symmetric electrodes are used for the spark gap, as is generally the case in conventional spark plugs, a larger current occurs when the slower positive charge carriers, namely the ions, travel toward the larger electrode.

U.S. Pat. No. 5,483,818 (Brandt et al.) discloses a circuit arrangement for detection of an ion current in which the low potential side or end of the secondary circuit of the secondary ignition winding is connected through a resistor to the inverting input of an operational amplifier, while the non-inverting input of this amplifier is connected to a reference voltage of about 40 V. This operational amplifier includes a resistor so connected that the amplifier functions as an inverting amplifier so that the reference voltage for measuring the ion current is connected to the secondary circuit and thus to the spark plug as a measuring voltage. The measuring voltage which represents the ion current or which is an ion current proportional signal at the output of the operational amplifier, is supplied to a threshold circuit for evaluation.

For discharging the ignition current generated during ignition two Zener diodes are connected in series and to the secondary circuit of the ignition transformer. A closed loop control circuit is provided for compensating for the leakage current that occurs in the Zener diodes. This leakage current falsifies the current component that represents the ion current. This closed loop compensation circuit is also controlled from the output of an operational amplifier. The closed loop compensation circuit comprises a further operational amplifier with respective resistors and a capacitor in the closed loop control circuit. The disadvantage of the circuit arrangement of U.S. Pat. No. 5,483,818 is seen in that its construction is involved so that its manufacturing costs are rather high.

OBJECTS OF THE INVENTION

In view of the above it is the aim of the invention to achieve the following objects singly or in combination:

- to provide an ignition circuit with circuit components that accurately measure the ion current without the above outlined disadvantages while using the spark plug or plugs as sensors for the ion current;
- to assure a high measuring quality under all operating conditions including cold starting conditions for measuring the ion current in the combustion chamber of an internal combustion engine, whereby the number of circuit components shall be optimally reduced; and
- to assure a constant measuring voltage that is constant throughout the duration of the measuring phase and to construct the ion current measuring circuit in such a way that the constancy of a relatively low measuring voltage advantageously affects the ion current signal.

SUMMARY OF THE INVENTION

An ion current measuring circuit in an ignition system of an internal combustion engine according to the invention is characterized in that circuit components forming an ion current measuring circuit are provided for applying a constant measuring voltage to the secondary circuit of the ignition transformer or coil. The constant measuring voltage has a voltage value equal to or smaller than the battery voltage of the ignition system, and wherein a rectifying element ($D_1$) is connected for supplying the secondary or ignition current generated during sparking phases of the spark plug to the battery of the system for charging the battery during these sparking phases.

The use of a measuring voltage according to the invention with a voltage value corresponding to the battery voltage or smaller avoids the disadvantages that occur when measuring voltages in the order of 40 to 400 V are used as described above. Furthermore, the use of such a low measuring voltage makes it possible to have a circuit arrangement at minimal expense, even though the invention uses a constant measuring voltage which remains constant throughout the measuring phase.

Such a low constant measuring voltage makes sure that the size of the ion current is directly proportional to the applied measuring voltage, since saturation does not occur and non-linearities are avoided. A saturation can, for example, occur in a flame ionization detector due to the high ion concentration and due to the small free sparking length along which the ions travel. Thus, the precision or constancy of the low measuring voltage has the advantage that its accuracy is directly affecting the quality and proportionality of the measured signal that represents the ion current.

Furthermore, the use of a low measuring voltage has another advantage that shunting resistances caused by spark gap sooting that conventionally occurs during cold starting are not significantly effective because the specific conductivity of soot is proportional to the applied voltage.

According to a further preferred embodiment of the invention, the spark gaps that form the ion current sensors during phases when an ion current is caused to flow by the applied constant low measuring voltage, are preferably connected in parallel to each other in multi-cylinder engines so that a single circuit arrangement can be used for measuring the ion current flowing through all spark gaps.

The preferred circuit component for the application of the low measuring voltage to the secondary circuit of the ignition coil includes a differential amplifier. According to a further embodiment of the invention, one input of the differential amplifier is connected to the reference voltage, the voltage value of which corresponds precisely to the measuring voltage and the differential amplifier is wired as an inverting amplifier so that the desired measuring voltage becomes available at the other input of the amplifier. This feature of the invention makes sure that the ion current generates with simple circuit components a precise voltage drop which is then supplied to an evaluating circuit such as a threshold circuit. This voltage drop is precisely linearly proportional to the ion current to be measured.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
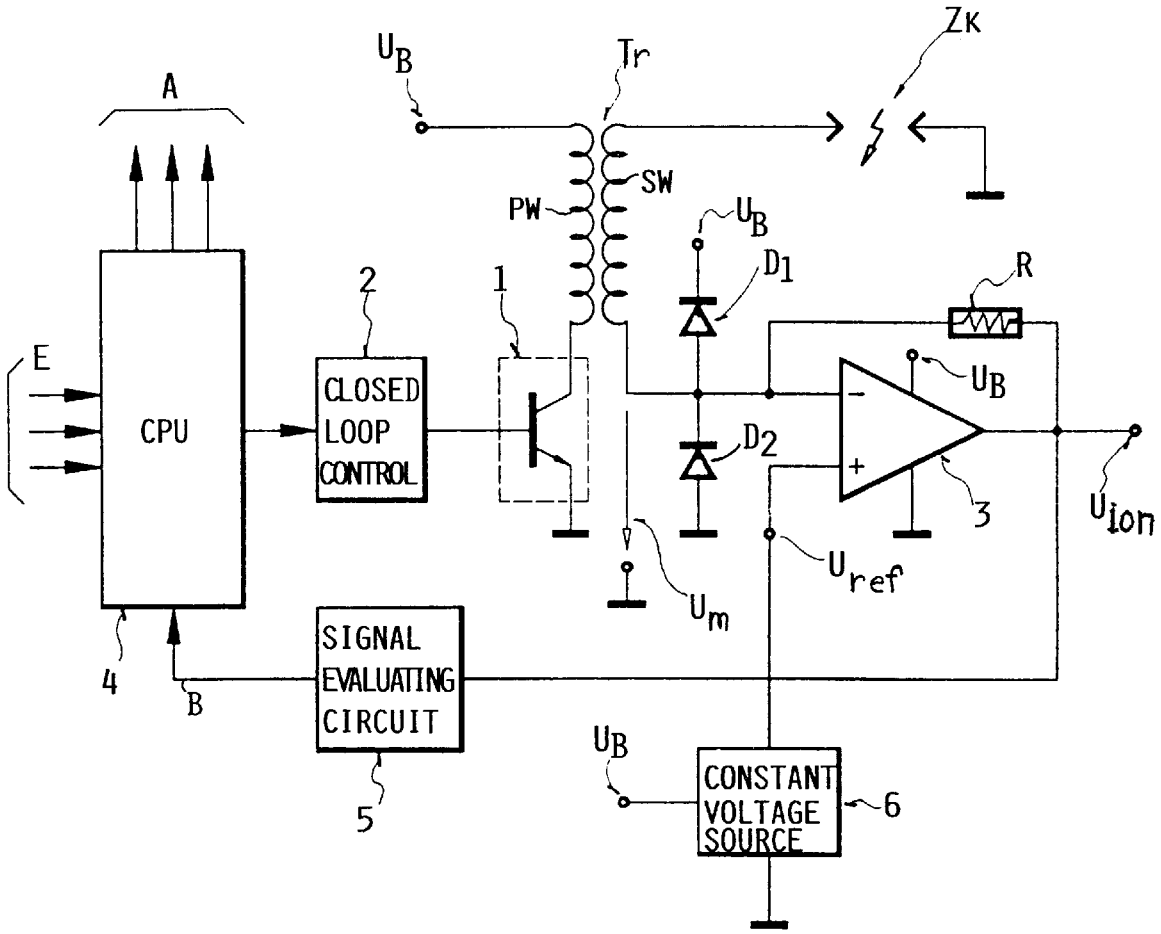
FIG. 1 shows a first example embodiment of a circuit arrangement for measuring the ion current of a single spark plug.

FIG. 1 shows a transistor ignition circuit of the invention, whereby for simplicity's sake only one spark plug Zk for an internal combustion engine is shown.

The ignition circuit comprises an ignition coil or transformer Tr with a primary coil or winding PW and a secondary winding SW.

The spark plug Zk is connected between ground and the high voltage end of the secondary winding SW. The primary winding PW is connected with one end to the vehicle battery $U_B$ providing, for example, a voltage of 12 V. The other end of the primary winding PW is connected to a power amplifier in the form of a power transistor 1 for charging the primary winding. The base or control electrode of the transistor 1 is connected through a closed loop control circuit 2 to a central processing unit 4. The central processing unit 4 provides the ignition impulses to the ignition transistor 1.

The secondary winding SW is connected with its high potential voltage end to the spark plug Zk. The low potential end of the secondary winding SW is connected to the inverting input (−) of a differential amplifier 3. According to the invention a constant reference voltage $U_{ref}$, preferably 5 V, is connected to the non-inverting input (+) of the differential amplifier 3. This constant reference voltage is provided by a constant voltage source 6. The constant reference voltage $U_{ref}$ is supplied through the differential amplifier 3 to the secondary circuit of the secondary winding SW connected to the spark plug Zk. Thus, this constant voltage functions as a constant measuring voltage $U_m$ across the ion measuring spark gap of the spark plug Zk which functions as an ion current sensor during times when the measuring voltage is applied between ignition or sparking impulses. The constant-measuring voltage $U_m$ is equal to the constant reference voltage $U_{ref}$.

The differential amplifier 3 is wired as an inverting amplifier. For this purpose a feedback resistor R is connected in parallel to the inverting input (–) and the output of the amplifier 3.

In order to provide a low ohmic path during the ignition at the spark plug Zk for the secondary current $I_{sec}$, diodes $D_1$ and $D_2$ are connected to the low potential end of the secondary winding SW. These diodes function as follows. The diode $D_1$ is connected in such a way between the inverting input (–) of the differential amplifier 3 and the vehicle battery UB that the ignition current can flow into the battery circuit thereby charging the battery when ignition current flows through the spark plug. The second diode $D_2$ is wired in such a way that its anode is connected to ground and so that its cathode is connected to the inverting input (–) of the differential amplifier 3, whereby negative voltage peaks are grounded. Such peaks can occur during sparking phases. The use of a diode for feeding the positive ignition currents into the battery circuit according to the invention has the advantage, compared to the use of Zener diodes, that leakage current of the normal diodes is substantially lower than leakage currents of Zener diodes.

In order to limit the current flowing into the differential amplifier 3, a resistor, not shown in FIG. 1, could be connected in the conductor to the inverting input (–) of the differential amplifier 3.

The inverting differential amplifier 3 converts the ion current $I_{ion}$ into a voltage $U_{ion}$ which is supplied as a measured signal to an evaluating unit 5, such as a threshold circuit connected with its input to the output of the amplifier 3. As mentioned above, the measuring voltage that is supplied to the secondary winding SW of the ignition transformer Tr is preferably 5 V and is kept constant during the entire measuring duration or measuring phase. Since the ion current to be measured is within the range of microamperes the differential amplifier 3 must be capable of handling such low input currents. Differential amplifiers with this capability are available on the market at reasonable cost.

Figure 2:
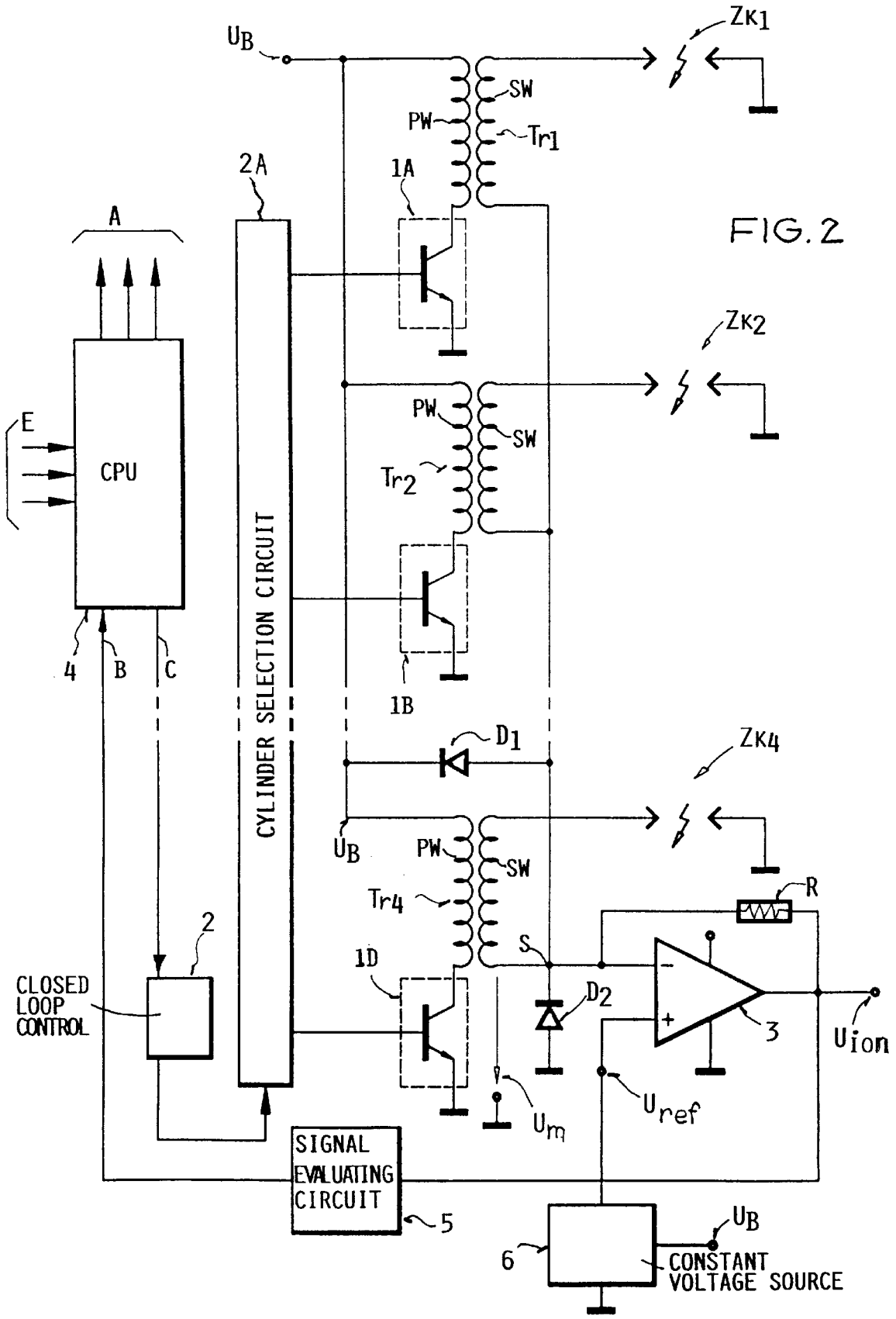
FIG. 2 is a circuit arrangement similar to that of FIG. 1, however showing the measurement of the ion current in four spark plugs of a four cylinder engine by a single circuit of the invention.

By providing the measuring voltage at a low impedance, recharging of stray capacities is avoided. Such recharging of stray capacities occur in known systems when loaded with an alternating current when the internal combustion engine is knocking, for example. This advantage of the invention is especially noticeable when several ion measuring circuits are connected in parallel with each other as will be described in more detail below with reference to FIG. 2. In the circuit of FIG. 2, the invention effectively eliminates the multiplication of stray capacities.

FIG. 1 further shows a central processing or control unit 4 which carries out the function of engine management and which provides an input signal to the closed loop control circuit 2. For this purpose the central processing unit 4 receives at its inputs E engine parameters such as a load parameter, an r.p.m. parameter, and at least one temperature parameter such as the engine temperature. Respective sensors are controlled through the outputs A of the central processing units 4. The evaluating circuit 5 provides an output signal representing the measured ion voltage $U_{ion}$ that is applied to an input B of the central processing unit 4 for further processing.

The ion current or rather its proportional ion voltage signal can be used, for example, in order to detect any engine knocking. This signal may be further used for controlling the ignition sequence to provide a correcting closed loop knocking control for eliminating knocking. The ion current signal, or rather its absence can also be used for detecting ignition failures. The measured signal can further provide information regarding the position of the cam shaft relative to the crankshaft.

In a four cycle engine it is possible that a cylinder has assumed a compression stage or an exhaust stage when the crankshaft and correspondingly the piston has assumed a position in which ignition should occur. Normal combustion, however, takes place only when the ignition occurs in the compression stage, thereby producing a corresponding ion current signal. When ignition should occur during the exhaust stage, the ion current signal is substantially zero, whereby the phase relationship between the crankshaft and camshaft can be ascertained.

FIG. 2 shows a transistor ignition system for a four cylinder internal combustion engine. The system comprises four ignition stages, one for each spark plug $Zk_1 \ldots Zk_4$. However, only three stages are shown for simplicity's sake. Each ignition stage comprises an ignition coil or transformer $Tr_1 \ldots Tr_4$. Each primary winding PW receives its charge from a respective power amplifier in the form of an ignition transistor 1A . . . 1D, which in turn is controlled through a cylinder selection or timing circuit 2*a* that receives its control input from a closed loop control circuit 2 which in turn is connected to the central processing unit 4 at its output C. Each control electrode of the power transistors 1A . . . 1D is connected to the circuit 2A.

For measuring the ion current, the low potential ends of the secondary windings SW are connected to a common circuit point S which in turn is connected through a diode $D_1$ to the battery circuit $U_B$ and through a further diode $D_2$ to ground as in FIG. 1. The circuit point S is further connected to the inverting input (–) of a differential amplifier 3 just as in FIG. 1. The inverting input of the amplifier 3 is connected to the output thereof by a feedback resistor R and the output signal provides an ion voltage $U_{ion}$ which represents the measured voltage which in turn is proportional to the ion current in the cylinder. A constant reference voltage $U_{ref}$ produced by the constant voltage source 6 is supplied to the non-inverting input of the amplifier 3. According to the invention the reference voltage is preferably smaller, but never larger than the battery voltage $U_B$ and in an example the reference voltage is 5 V, which provides the required constant measuring voltage $U_{Mes}$ at the circuit point S and thus also across the sparking gaps of the spark plugs $Zk_1 \ldots Zk_4$ connected in parallel.

The voltage $U_{ion}$ at the output of the differential amplifier 3 is supplied to the evaluating circuit 5 which in turn provides its output signal to an input B of the central processing unit 4. This circuit arrangement is identical to that of FIG. 1 and functions in the same way. The input of the inverting amplifier 3, more specifically the inverting input (–), may also be connected through a resistor to the circuit point S, thereby further limiting the current entering the differential amplifier 3. Further, the diode D1 shown in FIG. 1 may be used in the same connection in FIG. 2 for the same purpose of charging the battery during ignition phases.

The circuit arrangement for measuring ion current according to the invention is suitable, not only in connection with transition ignition systems, but also in other ignition systems such as alternating current ignition systems and high voltage capacitor ignition systems.

Although the invention has been described with reference to specific example embodiments, it will be appreciated that it is intended to cover all modifications and equivalents within the scope of the appended claims.

What is claimed is:

1. A circuit arrangement for measuring an ion current in a combustion chamber of a cylinder of an internal combustion engine, said circuit arrangement comprising an ignition transformer ($Tr_1 \ldots Tr_4$) having a primary winding (PW) forming a primary circuit and a secondary winding (SW) forming a secondary circuit, a battery ($U_B$) connected to said primary circuit for providing a supply voltage, at least one spark plug (Zk) connected to said secondary circuit, said at least one spark plug forming an ion current sensor during an ion current flow phase through said spark plug following an ignition or sparking phase in said spark plug, a measuring circuit (3, R) connected to a low potential end of said secondary winding (SW), said measuring circuit comprising a constant voltage source (6) for supplying a constant measuring voltage to said secondary winding of said secondary circuit, said constant measuring voltage having a value which is equal to or smaller than said supply voltage provided by said battery ($U_B$), and further comprising a rectifying element ($D_1$) connected to said low potential end of said secondary winding (SW) and to said battery ($U_B$) for feeding a secondary current ($I_{sec}$) generated in said secondary winding (SW) during ignition phases or sparking of said at least one spark plug (Zk) into said battery ($U_B$) for charging said battery during said ignition phases.

2. The circuit arrangement of claim 1, wherein said rectifying element is a semiconductor diode ($D_1$) for charging said battery ($U_B$) during said ignition phases.

3. The circuit arrangement of claim 1, comprising a plurality of ignition transformers with respective secondary windings and respective spark plugs therein, each of said spark plugs forming an ion current sensor, and wherein sparking gaps of said spark plugs forming Part of said measuring circuit are connected in parallel with each other.

4. The circuit arrangement of claim 1, wherein said measuring circuit comprises a differential amplifier (3) having an output, an inverting input (–), and a non-inverting input (+), and a feedback circuit component (R) connected to said output and to said inverting input of said differential amplifier to make said differential amplifier an inverting differential amplifier.

5. The circuit arrangement of claim 4, wherein said inverting input (–) of said differential amplifier (3) is connected to a low potential side of said secondary circuit and wherein said non-inverting input (+) of said differential amplifier is connected to said constant voltage source providing a constant reference voltage ($U_{ref}$) having a value corresponding to said constant measuring voltage, and wherein said feedback circuit component is a feedback resistor (R) connecting said output of said differential amplifier to said inverting input (–) of said differential amplifier (3).

6. The circuit arrangement according to claim 4, further comprising a second diode ($D_2$) connected between ground potential and said inverting input of said differential amplifier for dissipating negative voltage peaks to ground potential.

7. The circuit arrangement of claim 4, further comprising a signal evaluating circuit (5) having an input connected to said output of said differential amplifier (3) for providing at an output of said evaluating circuit an ion current representing signal.

* * * * *